US006607257B2

(12) United States Patent
Szumla et al.

(10) Patent No.: US 6,607,257 B2
(45) Date of Patent: Aug. 19, 2003

(54) PRINTHEAD ASSEMBLY WITH MINIMIZED INTERCONNECTIONS TO AN INKJET PRINTHEAD

(75) Inventors: Thomas P. Szumla, Lockport, NY (US); Manh Tang, Penfield, NY (US); David A. Johnson, Rochester, NY (US); David S. Madziarz, Bergen, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/960,109

(22) Filed: Sep. 21, 2001

(65) Prior Publication Data

US 2003/0058288 A1 Mar. 27, 2003

(51) Int. Cl.[7] ..... B41J 29/38
(52) U.S. Cl. ..... 347/12; 347/48; 347/82
(58) Field of Search ..... 347/73, 82, 54, 347/48, 180, 12, 211

(56) References Cited

U.S. PATENT DOCUMENTS

| | | | | | |
|---|---|---|---|---|---|
| 4,364,063 | A | * | 12/1982 | Anno et al. | 346/76 |
| 4,695,853 | A | | 9/1987 | Hackleman et al. | 346/140 |
| 4,751,531 | A | | 6/1988 | Saito et al. | 346/140 |
| 4,878,065 | A | | 10/1989 | Fukushima et al. | 346/76 |
| 4,882,686 | A | | 11/1989 | Gretter | 364/518 |
| 5,142,302 | A | * | 8/1992 | Kano | 346/76 |
| 5,502,471 | A | | 3/1996 | Obermeier et al. | 347/65 |
| 5,543,828 | A | * | 8/1996 | Minowa | 347/195 |
| 5,838,339 | A | | 11/1998 | Silverbrook | 347/9 |
| 5,975,670 | A | * | 11/1999 | Kikuta et al. | 347/15 |
| 6,019,457 | A | * | 2/2000 | Silverbrook | 347/65 |
| 6,079,821 | A | * | 6/2000 | Chwalek et al. | 347/82 |
| 6,179,411 | B1 | * | 1/2001 | Saikawa et al. | 347/48 |
| 6,217,163 | B1 | | 4/2001 | Anagnostopoulos et al. | 347/75 |
| 6,224,184 | B1 | * | 5/2001 | Imanaka et al. | 347/19 |

* cited by examiner

*Primary Examiner*—John Barlow
*Assistant Examiner*—Lam S Nguyen
(74) *Attorney, Agent, or Firm*—Norman Rushefsky

(57) ABSTRACT

An inkjet printhead assembly (50) for an inkjet printer having a printhead (10) with a plurality of nozzles (24) and data path and control electronics circuitry (56) operably coupled with the printhead (10) for providing image data that control the flow of ink through the nozzles (24). The nozzles (24) are arranged in sections with at least two heater elements, an upper heater (28*a*) and a lower heater (28*b*), predisposed about each nozzle (24), the heater elements configured to actuate a nozzle (24) for printing. The data path and control electronics circuitry (56) comprises a plurality of shift registers (100, 102) configured to drive the nozzles, causing them to deliver ink in the direction of a receiver media, such as paper. Interconnections (54) between the data path and control electronics circuitry (56) and printhead (10) include DATA, CLOCK, LATCH and ENABLE lines which are used to operate the printhead (10) and, in turn, the nozzles (24) via the shift register stages (100, 102). The number of interconnections are minimized by interleaving data to the shift registers between upper and lower heater elements of the printhead (10) or by interleaving the data on the DATA line to the shift register stages (104, 106) for the upper and lower heater elements.

38 Claims, 11 Drawing Sheets

SEE FIG. 5
28a1
28b1
28a2
28b2
28aN
28bN
28aN+1
28bN+1
28aN+2
28bN+2
28a2N
28b2N
86
88
90
91
94
80
102
100
104
106
92
N-bits SERIAL SHIFT REGISTER M
N-bits SERIAL SHIFT REGISTER I
N-bits SERIAL SHIFT REGISTER 0
UPPER_ENABLE
LOWER_ENABLE
UPPER_LATCH
LOWER_LATCH
DATA U 0
UPPER_CLOCK
DATA U I
DATA U M
DATA L 0
LOWER CLOCK
DATA L I
DATA L M

PRINTHEAD ASSEMBLY WITH MINIMIZED INTERCONNECTIONS TO AN INKJET PRINTHEAD

FIELD OF THE INVENTION

The invention relates in general to a recording apparatus such as an inkjet printhead and, more specifically, to a printhead assembly that reduces the number of electrical interconnections in an inkjet printhead. More particularly, the invention relates to a shift register configuration that interleaves print data between upper and lower actuators in an inkjet printhead assembly.

BACKGROUND OF THE INVENTION

Without limiting the scope of the invention, its background is described in connection with thermal inkjet printers, as an example.

Modern printing relies heavily on inkjet printing techniques. The term "inkjet" as utilized herein is intended to include all drop-on-demand or continuous inkjet printer systems including, but not limited to, thermal inkjet, piezoelectric, and continuous, all of which are well known in the printing industry. Essentially, an inkjet printer produces images on a receiver medium, such as paper, by ejecting ink droplets onto the receiver medium in an image-wise fashion. The advantages of non-impact, low-noise, low-energy use, and low cost operation, in addition to the capability of the printer to print on plain paper, are largely responsible for the wide acceptance of inkjet printers in the marketplace.

The printhead is the device that is most commonly used to direct the ink droplets onto the receiver medium. A printhead typically includes an ink reservoir and channels which carry the ink from the reservoir to one or more nozzles. Typically, sophisticated printhead systems utilize multiple nozzles for applications such as high-speed continuous inkjet printer systems, as an example. Continuous inkjet printhead device types include electrostatically controlled printheads and thermally steered printheads. Both printhead types are named according to the means used to steer ink droplets ejected from nozzle openings. It is well known in the art of inkjet printing that multiple actuators or heating elements per inkjet nozzle can be used. For example, U.S. Pat. No. 4,751,531 describes the use of a two heater printing nozzle while U.S. Pat. No. 4,695,853 describes the use of a vertical array of 9 heating elements per nozzle. In order to optimize drop formation conditions, it is preferred to utilize independent control circuits for such multi-actuator print nozzle configurations.

At the same time, there are also practical limitations with respect to the number of layers necessary to implement the control circuits as well as limitations in the number of interconnections that are practical in order to make the design useful and operable. These type of design constraints require the use of serial shift registers to bring the print data to the printhead during printing. Between the stated design constraints and the desire to minimize interconnections lies an optimum solution for multi-actuated printheads.

Accordingly, what is needed is a way of minimizing interconnections in a multi-actuated thermal inkjet printer. A printhead assembly with minimal shift registers and interconnections in a multi-actuated printhead assembly would provide numerous advantages.

SUMMARY OF THE INVENTION

The present invention provides a solution to dealing with the task of minimizing the number of interconnections used in a multi-actuated configuration printhead. The invention provides a printhead assembly with a reduced number of electrical interconnections that decreases the number of signals that interface the printhead to the image rastoring electronics.

According to the invention, disclosed is a recording apparatus comprising a plurality of recording elements arranged in an array for recording of an image on a receiver medium and a plurality of actuators associated with each respective recording element, each actuator being separately drivable to affect recording by a respective recording element. A plurality of shift register stages are provided, each stage being associated with a respective actuator, each recording element being associated with different shift register stages, the shift register stages being adapted to shift data from one stage to a next stage to distribute data to the different stages so that data shifted into a stage associated with an actuator may be shifted into a stage associated with another actuator in the course of shifting data from stage to stage.

In one embodiment, the actuators comprise heater elements configured as upper and lower heaters about each of the nozzles. The heater elements can be arranged into upper and lower heaters and the shift register stages interleaved so that some are arranged to operate upper heaters and others are arranged to operate lower heaters. The plurality of interconnections provide upper and lower enable lines operably coupled to the heaters for operating the recording elements in connection with the upper and lower shift registers, respectively.

Further disclosed is an inkjet printhead comprising a plurality of nozzles having corresponding nozzle openings for delivering ink unto a specified receiver medium and a plurality of shift registers operably coupled to the actuators associated and adapted to cause ink to be delivered through the nozzles openings in the direction of the receiver medium. A print data driving means is operably coupled to the shift registers via a plurality of interconnections and the shift registers are interleaved to minimize the number of interconnections.

In one embodiment, the actuators comprise heaters designated as upper and lower heaters and the shift registers are interleaved so that some are arranged to operate upper heaters and others are arranged to operate lower heaters. The interconnections include data lines for delivering print data signal and clock lines for delivering timing signals to said lower and upper shift registers. The data lines are interleaved between upper shift registers and lower shift registers. The print data driving means is configured to operate the clock lines by transmitting a clock signal that causes upper and lower shift registers to shift data received over data lines and thereby operate the plurality of heaters.

Further disclosed is an inkjet printer comprising a printhead nozzle assembly with a plurality of nozzles, each of the nozzles comprising a nozzle opening through which ink in the form of ink drops is ejected. An ink supply system is configured to supply ink to the printhead nozzles assembly with data path and control electronics circuitry operably coupled to the printhead nozzle assembly for providing image data to the printhead nozzle assembly. The printer further comprises means for delivering the image data to the printhead nozzle assembly. The printhead nozzle assembly further comprises at least two heater elements, an upper heater and a lower heater, predisposed about each of the nozzles, the heater elements configured to actuate each of the nozzles for printing. The data path and control electronics circuitry comprises a plurality of shift registers configured to drive the nozzles by causing them to deliver ink in the direction of a receiver media. The data path and control electronics circuitry further comprises a print data driver operably coupled to the shift registers and configured to deliver print data at specified times to the shift registers in order to cause the nozzles to deliver ink at specified locations and at specified times on the receiver media.

A technical advantage of the present invention is a cost effective method of controlling a printhead assembly in a thermal inkjet printhead.

Another technical advantage includes optimum compromise between the length of shift registers and number of heaters to be controlled. In one standard printhead configuration, twenty 128-bit shift registers are able to operate a 1280 nozzle assembly.

BRIEF DESCRIPTION OF THE DRAWINGS

For a more complete understanding of the present invention, including its features and advantages, reference is made to the following detailed description of the invention, taken in conjunction with the accompanying drawings in which.

Corresponding numerals and symbols in these figures refer to corresponding parts in the detailed description unless otherwise indicated.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. For example, the specific embodiments discussed herein are described in the context of nozzles used in an inkjet printhead which act as recording elements for recording images on a receiver medium, such as paper. It should understood, however, that other types of recording elements such as LEDs, thermal recording elements, and lasers, among others may benefit from the advances provided by the invention. The specific examples discussed herein are merely illustrative of specific ways to make and use the invention, and do not delimit the scope or application of the invention.

Figure 1:
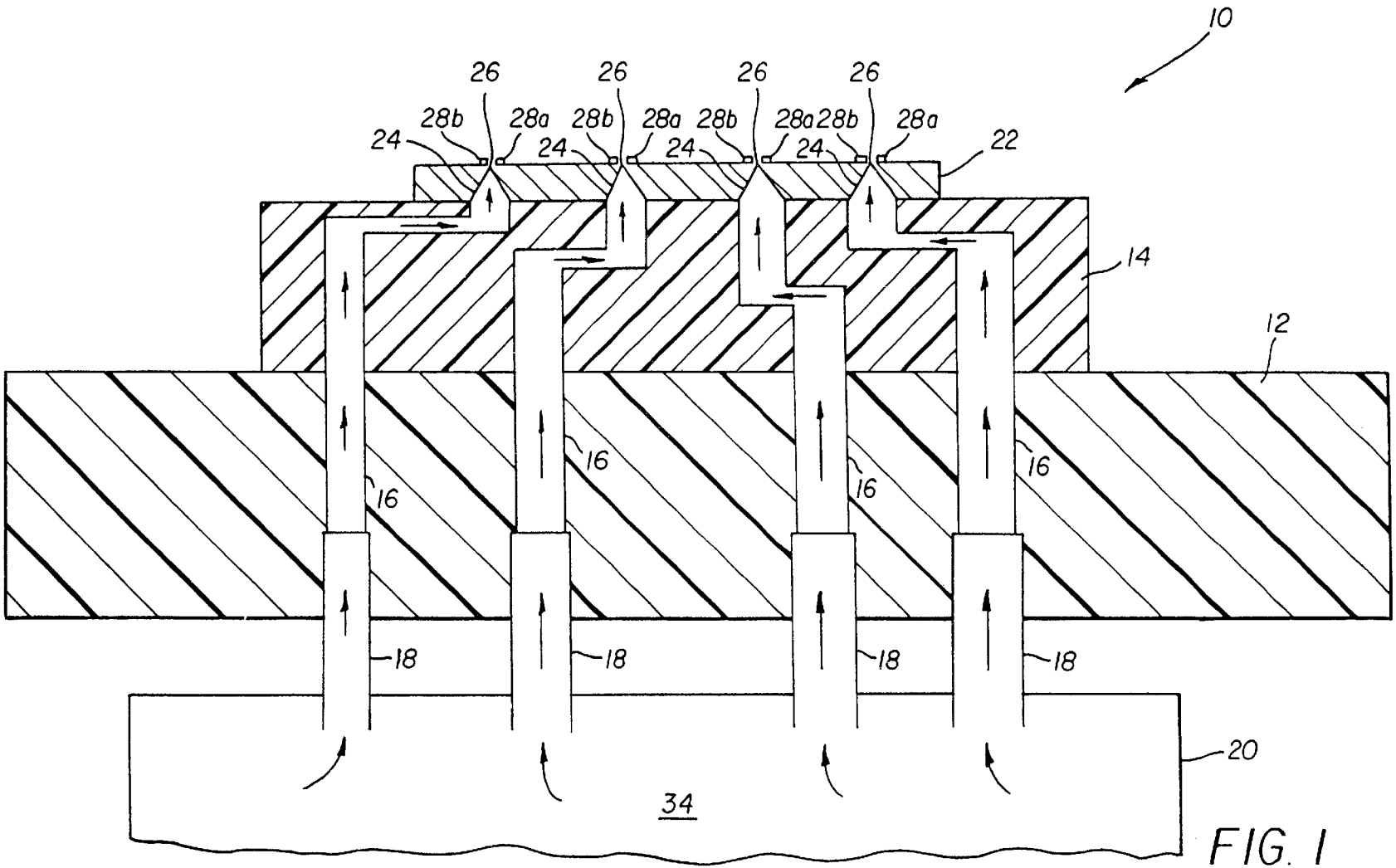
FIG. 1 is a diagram illustrating an inkjet printhead with a plurality of nozzle openings through which ink flows.

Referring to FIG. 1, therein is shown a cross-section of an inkjet printhead 10 of the type commonly employed in thermal inkjet printers. More specifically, inkjet printhead 10 is a device that is commonly used to direct ink droplets or "drops" onto a receiver medium, such as paper, in an inkjet printer (not shown) and comprises one of several types of recording apparatus to which the invention may be applied. With the inkjet printhead 10, ink drops exit rapidly enough so as to form an ink drop stream. The terms "ink drops", "ink droplets", "ink stream", and "ink" will be used interchangeably throughout.

Inkjet printhead 10 includes an ink reservoir 20, fluid-flow channels 18 and inlet/outlet tubes 16 which carry the ink 34 from the reservoir 20 to one or more recording elements or nozzles 24. For convenience and conformity to the figures, the term "nozzles" will be used throughout although it should be understood that nozzle comprises but a single type of recording element to which the invention may be applied. Inkjet printhead 10 also comprises a mounting block 12, a manifold 14, and a substrate 22 which internally define the fluid flow channels 18, providing paths from the ink reservoir 20 to the nozzles 24. Typically, the number of nozzles 24 is numerous providing an inkjet printhead with as many as 160, 320 or 1,280 nozzles, according to the design resolution and quality of printhead assembly. Those skilled in the art will appreciate that the figures are not drawn to scale and have been enlarged in order to illustrate the major aspects of the inkjet printhead 10.

Some inkjet printheads are made using thermally steered ink drop technology. As such, thermally steered inkjet printheads utilize thermal means to steer a continuous stream of ink drops ejected from each of a plurality of nozzle openings 26 in the inkjet printhead 10. Each of the nozzle openings 26 is also referred to as an "orifice" or a "bore" in the art. For thermal steering, inkjet printhead 10 includes a plurality of upper heaters 28*a* and lower heaters 28*b* (also known as actuators), located about the nozzle openings 26 to permit thermal steering. Specifically, each pair of heaters 28*a*, 28*b* are predisposed about a single nozzle opening 26 for directing the flow of ink drops 34 through the nozzle openings 26. For simplicity, the terms "heater" and "heaters", "actuator" and "actuators", will be used interchangeably and to refer to the singular and plural form of the corresponding part. For reference, U.S. Pat. No. 6,079,821 describes the operation of such a thermally steered continuous inkjet printing in detail. Commonly assigned U.S. application Ser. No. 09/607,840, filed in the name of Lee et al describes operation of thermally steered drop-on-demand inkjet printing.

Figure 2:
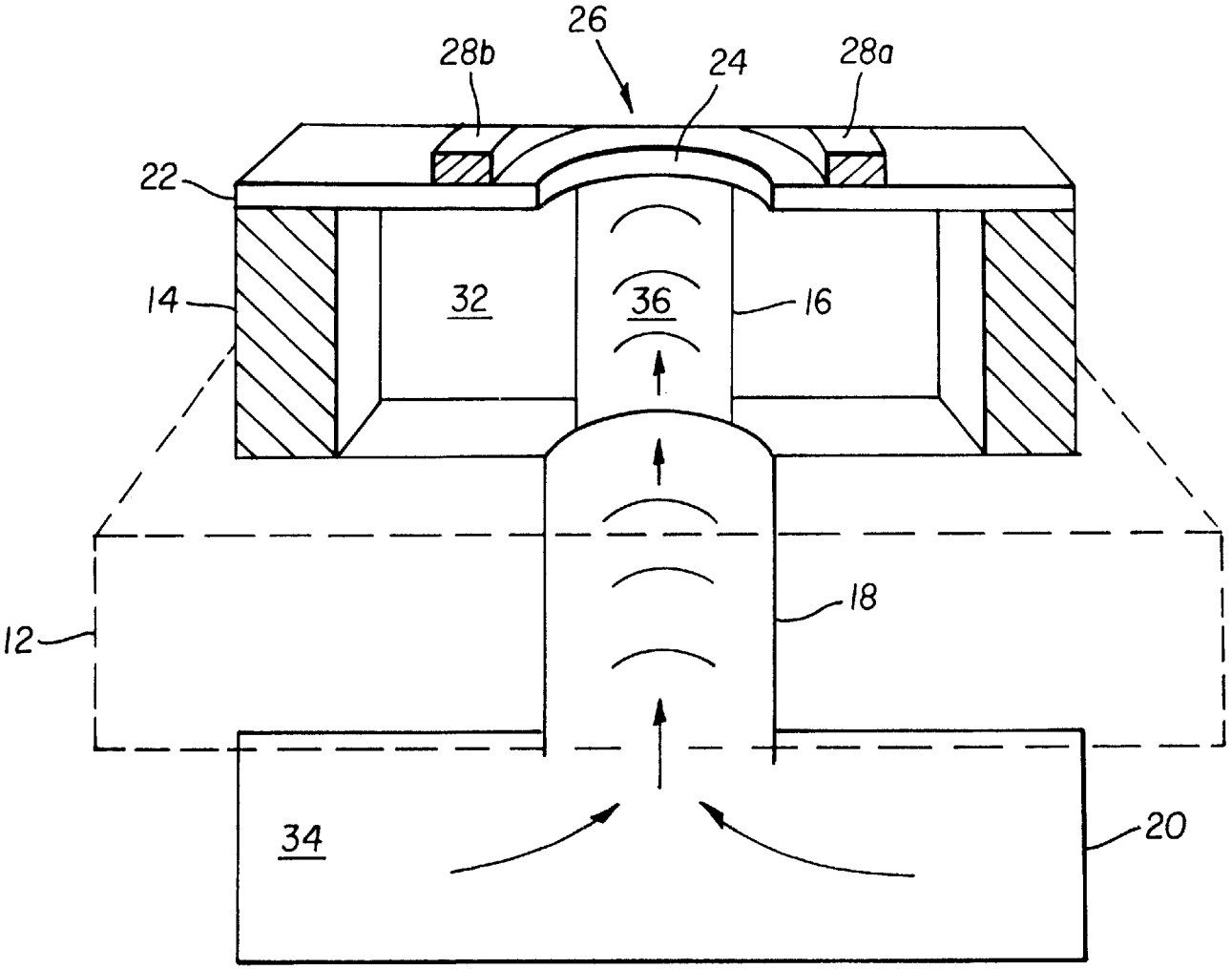
FIG. 2 illustrates a single printhead nozzle with two heater elements.

FIG. 2 is a cross-section view in perspective of a thermally steered inkjet printhead, such as printhead 10, illustrating the use of heaters 28*a*, 28*b*. Substrate 22 is attached to the gasket manifold 14 which, in turn, is bonded to the mounting block 12 in order to form the sub-assembly of inkjet printhead 10. The mounting block 12 and the gasket manifold 14 together form a delivery system wherein fluid flow channels 18 are defined. Each fluid flow channel 18 provides a route for the ink stream 36 to exit the nozzle 24 through openings 26. Predisposed about the nozzle opening 26 are heaters 28*a* and 28*b*, which are used to direct the flow of ink stream 36 through the nozzle opening 26 via thermal deflection.

Typically, heaters 28*a*, 28*b* are arranged in a split-ring fashion about a corresponding nozzle opening 26. That is, heaters 28*a*, 28*b* comprise an upper heater and a lower heater that allow for thermal deflection of the ink stream 36 exiting the nozzle opening 26 onto a receiver medium, such as paper. Therefore, if an ink stream 36 directed to the upper direction is desired, the lower heater 28*b* is heated, causing the ink stream 36 to bend in the upper direction. If, however, an ink stream 36 directed to the lower direction is desired, then the upper heater 28*a* is heated, causing the ink stream 36 to bend to the lower direction.

A nozzle 24 comprises a nozzle cavity 32 for facilitating the flow of ink 34 from the reservoir 20. In operation, ink from the nozzle cavity 32 is ejected through the opening 26 and exits as an ink stream 36. At a distance removed from the printhead 10, the ink stream 36 breaks up into ink drops traveling in the same direction as the ink stream 36. Heat pulses applied to one or more heaters 28 cause the ink stream 36 to be directed in a printing direction or in a non-printing direction. Typically, ink is recycled from the non-printing direction using a gutter assembly (not shown) that directs the ink to a recycling unit (not shown). Thus, ink 34 travels from the ink reservoir 20 through the fluid flow channels 18 to the inlet/outlet tubes 16 in order to exit the nozzle openings 26. The flow of ink through the nozzle opening 26 is facilitated by a print engine including a print data driver that drives each nozzle 24 in order to cause ink to flow through a nozzle opening 26 in the desired direction. The electronics utilized to achieve this function include data path and control electronics that are responsible for generating the print data and controlling the flow of print data from the print engine to the printhead. In the design of a printhead electrical interface, it is desired to minimize the number of signals and interconnections of the interface.

Figure 3:
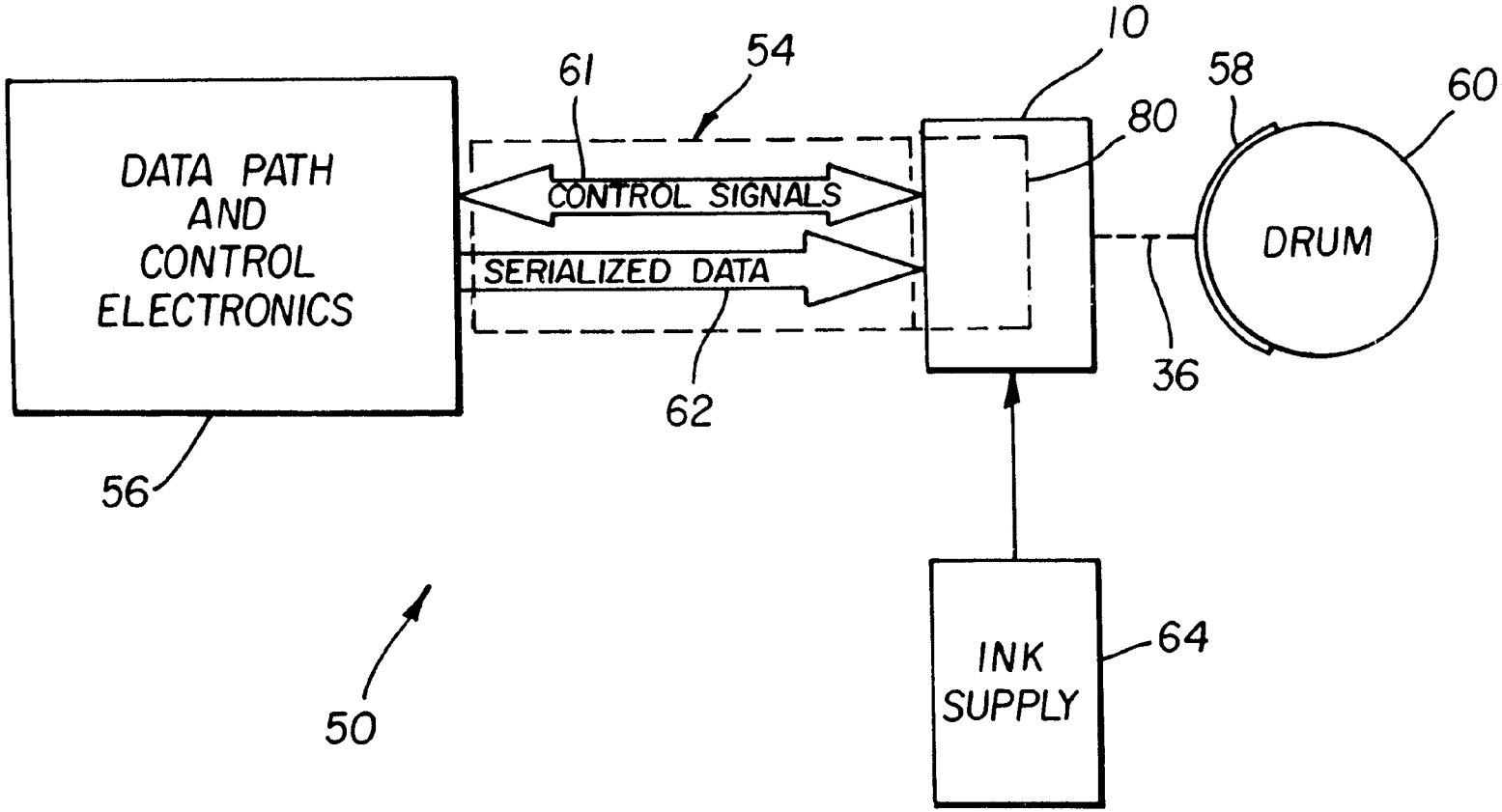
FIG. 3 is high-level block diagram of a thermal inkjet printhead assembly where data to the printhead is serialized.

FIG. 3 illustrates the use of data path and control electronics in a printer system 50 utilizing a thermal inkjet type printhead, such as printhead 10, where data serialization is applied. Printer system 50 includes a printhead 10 which utilizes two heater elements per nozzle (not shown in FIG. 3). The printhead 10 applies ink to media 58 mounted on a drum 60. In other configurations, the media may be mounted on a flatbed, and the printhead 10 positioned by way of a carriage to print onto the media 58. Ink is supplied to the printhead 10 from an ink supply system 64. The data path and control electronics 56 provides control signals 61 to the printhead 10 via interface 54.

As shown, interface 54 includes a serial DATA line 62 which carries serialized data to the printhead 10. The data is ported through a serial data shift register (discussed below) that restores the parallel nature of the data so that accurate printing is achieved. The data is routed so the assigned raster data is delivered to each of the heaters. Essentially, the data path and control electronics 56 ensures that while data for the next line of an image is being serially shifted down the serial shift register, current data for the line has been latched (saved) and is gated with an "enable" pulse to provide the correct amount of ink to be applied to the media being printed.

Physically, interface 54 includes a cable installed within the printer system 50 as part of the printhead assembly. The interface 54 also includes the various logic circuits, signal paths and discrete devices, and other similar components. Depending on the design resolution of the printhead 10, such components can consume considerable real estate on the printhead assembly. Therefore, the present invention provides a printhead assembly that minimizes the number of interconnections between the data path and control electronics 56 and the printhead 10.

Figure 4:
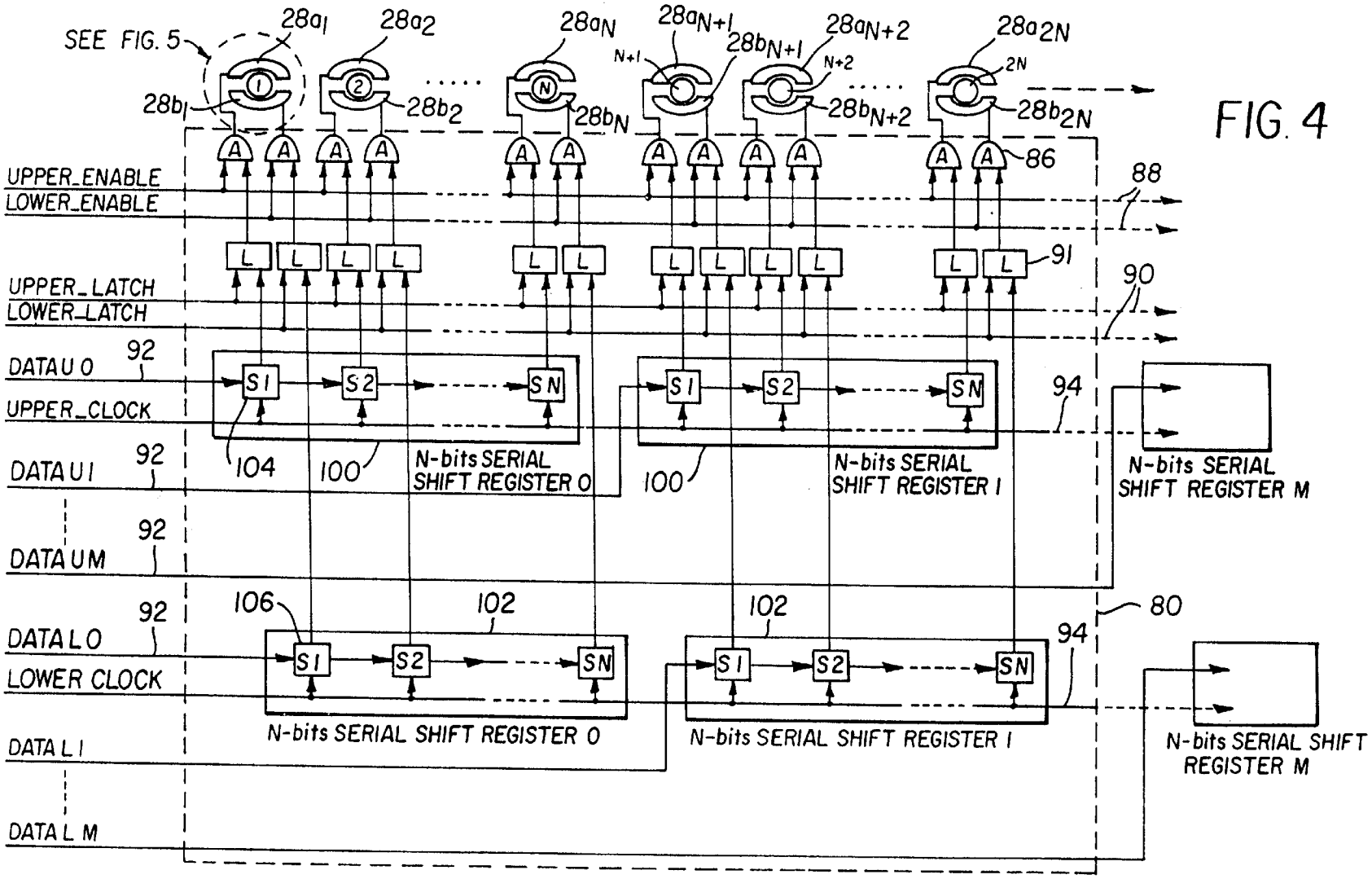
FIG. 4 is a detailed block diagram of the electrical interface within a printhead assembly using a serial shift register for driving nozzles in the printhead.

With reference now to FIG. 4, therein is shown a first embodiment of the invention, in the form of a block diagram of an interface 80 contained within the printhead 10. In essence, the interface 80 of the present invention uses serial shift registers to minimize the number of data lines required to drive the printhead 10. The interface 80 is configured to operate between the data path and control electronics 56 and the printhead 10 of the printhead assembly in which it is used. It should be understood that the interface 80 of FIG. 4 only shows a small number of circuits compared to what would be used in a more typical printhead supporting a larger number of printing nozzles.

As shown, serial shift register 100 is composed of N shift register stages 104 connected in a serial fashion. Likewise, serial shift register 102 is composed of N shift register stages 106 connected in a serial fashion. In the configuration shown, serial shift register 100 of N shift register stages 104 supports data transfer to the upper nozzles, while serial shift register 102 with N shift register stages 106 supply data for the lower heaters. Data is clocked through the shift register stages 104, 106 upon the occurrence of a rising edge on the "CLOCK" line 94 with a separate clock line implemented for upper and lower heaters. When data has been loaded to all the elements in the serial shift register stages 100, 102, the Q outputs of the shift register stages 104, 106 are captured by use of latch registers 91 via LATCH lines 90. The latched data then serves to validate whether heat is applied to or not applied at a particular nozzle heater 28. The output from the latch register 91 is gated using an AND logic element 86 with a pulse from an ENABLE line 88 and if a particular heater 28 is chosen for actuation, the latch output will be valid. The result of this AND operation is then used to switch on the NOZZLE HEATER DRIVER 84, thus allowing the heater element to be biased with the heater power source.

In an actual printhead, the length of each of the N-bit serial shift registers 100, 102 is likely to be 32, 64, 128, 256, or 512 bits. The length of each of the N-bit serial shift registers 100, 102 has a significant impact on the speed of access to an individual heater 28. As previously explained, all N bits in the shift registers 100, 102 must be loaded before the LATCH lines 90 can be actuated to transfer the contents of the shift registers into the latch registers 91. The period of time required to load an N-bit serial shift register limits how rapidly an individual heater can be addressed which, in turn, limits how rapidly a heater can be turned ON and then OFF. The minimum time required to address a heater is a function of the frequency of the clock signal on the CLOCK line 94 and the number, N, of shift register stages 104, 106 contained within the N-bit serial shift register 100 or 102. This relationship is governed by Equation 1 as follows:

$$\text{Minimum Heater Address Time}=(1/\text{freq}_{clock})*N \qquad \text{Equ. 1}$$

The upper limit in the choice of a clock frequency is often constrained by the speed of the shift register circuitry. To optimize the heater address time, the serial shift register, 100 or 102, should contain fewer shift register stages 104 or 106, to minimize the value of N. However, for a fixed number of nozzles in the printhead, if N is small there will be a larger number of serial shift registers 100 and 102. In a conventional printhead design each additional serial shift register requires an additional DATA line 92 and a corresponding additional electrical interconnection to the printhead. A large number of N-bit serial shift registers 100 and 102 will require a large number of electrical interconnections to the printhead, which can be costly or physically incompatible with the desire to manufacture small printheads.

Thus, a design conflict exists between minimizing heater address time and minimizing the number of interconnects to the printhead. To minimize the number of DATA lines 92 to the printhead, the number of shift register stages, N, in the N-bit serial shift registers 100, 102 would be maximized. However, a large value of N significantly increases the time to address an individual heater and may not be compatible with the fluids in use as well as the printing rates desired. Therefore, the present invention provides additional embodiments and methods of reducing the number of interconnects in the printhead assembly that take into account the heater address time.

Figure 5:
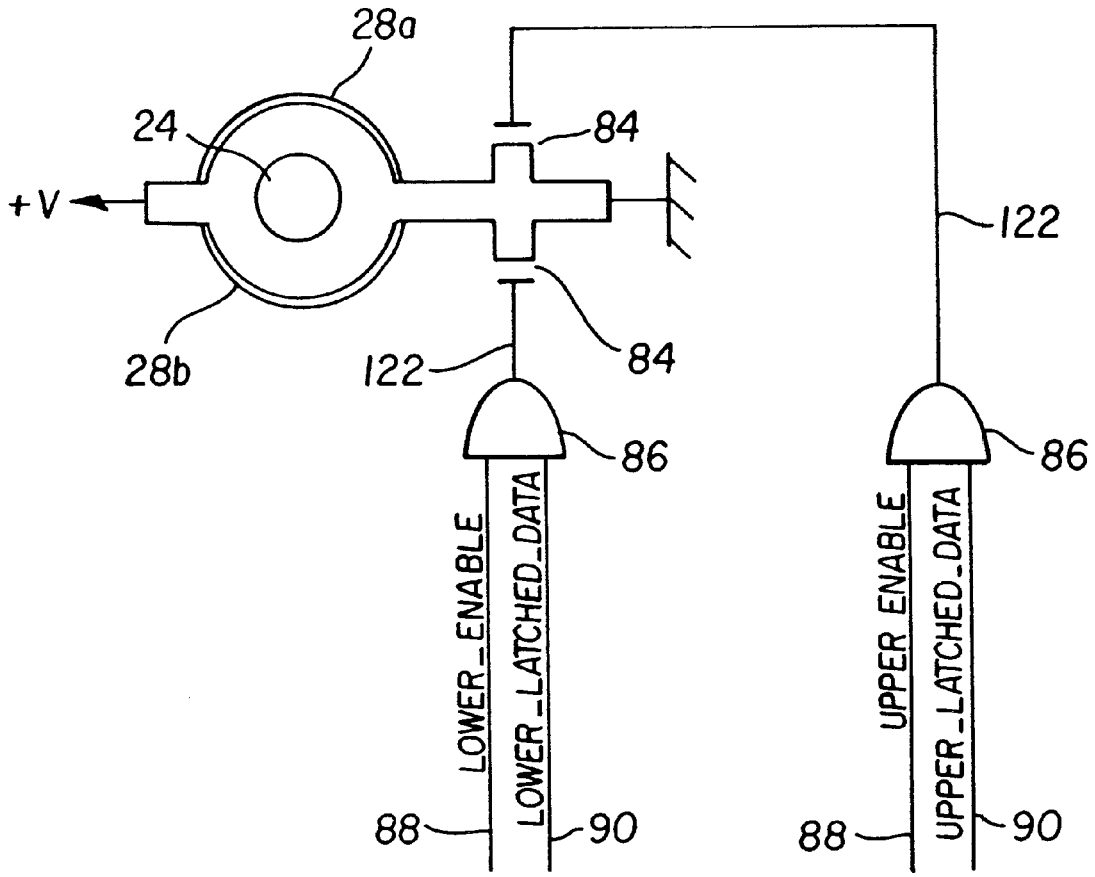
FIG. 5 is a circuit diagram of the interconnection between the nozzle heaters and the nozzle drivers.

With reference to FIG. 5, therein is shown the details of the nozzle heaters 28, which will guide in understanding the additional embodiment of the invention. Heaters 28*a*, 28*b* are located at the opposing sides of a printhead nozzle 24. An ENABLE line 88 and LATCHED_DATA line 90 are ANDED together at AND gate 86. The output 122 of the AND gate 86 provides a signal to a heater driver 84 which applies power to either upper heater 28*a* or lower heater 28*b*, as appropriate. In this example, either one of the two heaters 28*a* or 28*b* associated with a nozzle 24, is capable of actuating the nozzle. Applying power to either the upper heater 28*a* or the lower heater 28*b* will cause the ink droplet stream to deflect away from the energized heater.

Figure 6:
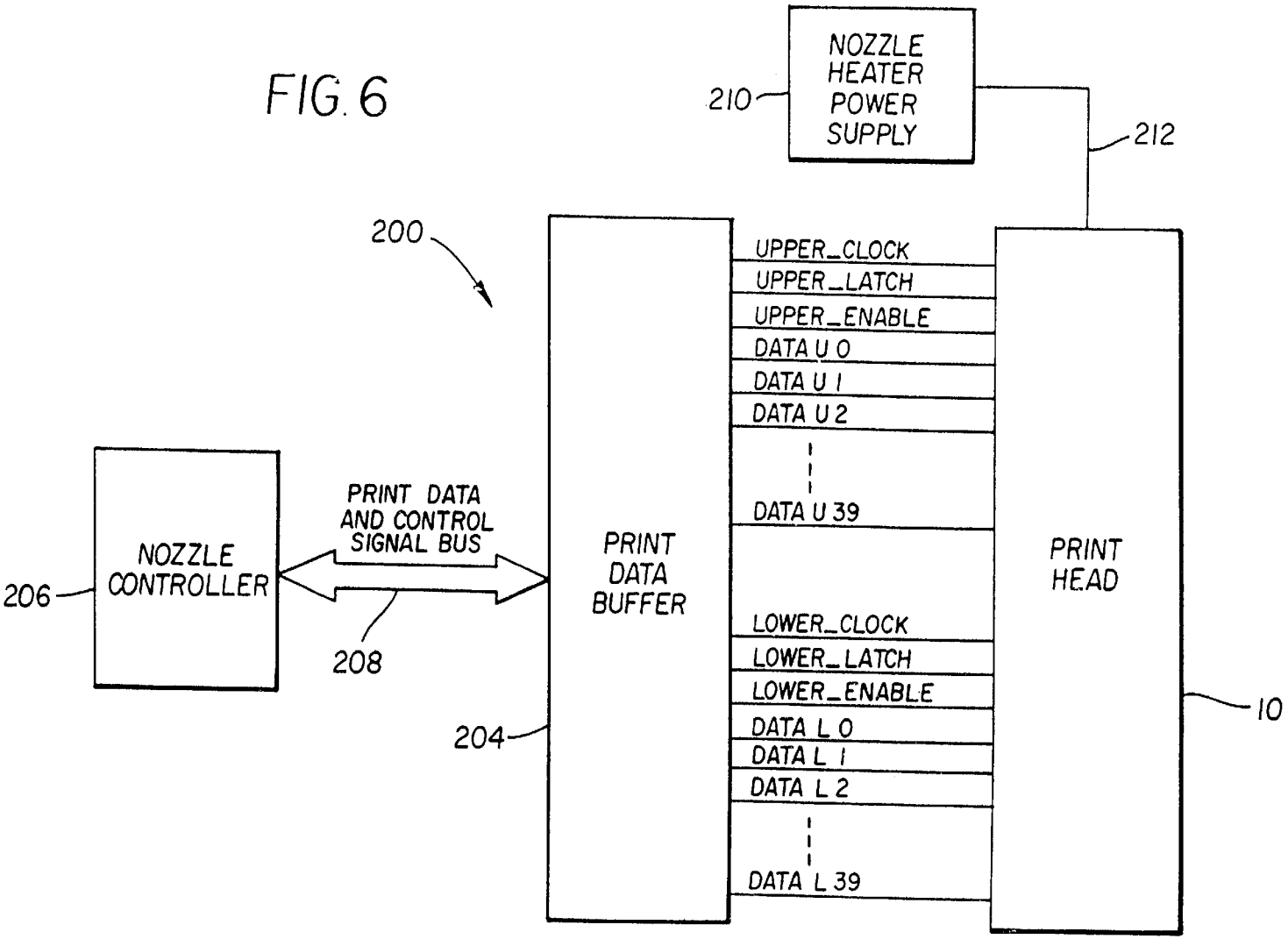
FIG. 6 is a block diagram of the interconnection of the printing system to the printhead.

With reference now to FIG. 6, therein is shown a printhead assembly, denoted generally as 200, with interconnections between the print data buffer 204 and the printhead 10. The nozzle controller 206 processes the image path data to be compatible with the printhead 10 and provides the control signals necessary to operate the printhead 10. The nozzle controller 206 also transfers the data and control signals via the print-data-and-control-signal bus 208 to the print data buffer 204 which provides a buffer function for all of the signals to the printhead 10. The nozzle heater power supply 210 provides power to the printhead via power line 212.

Figure 7:
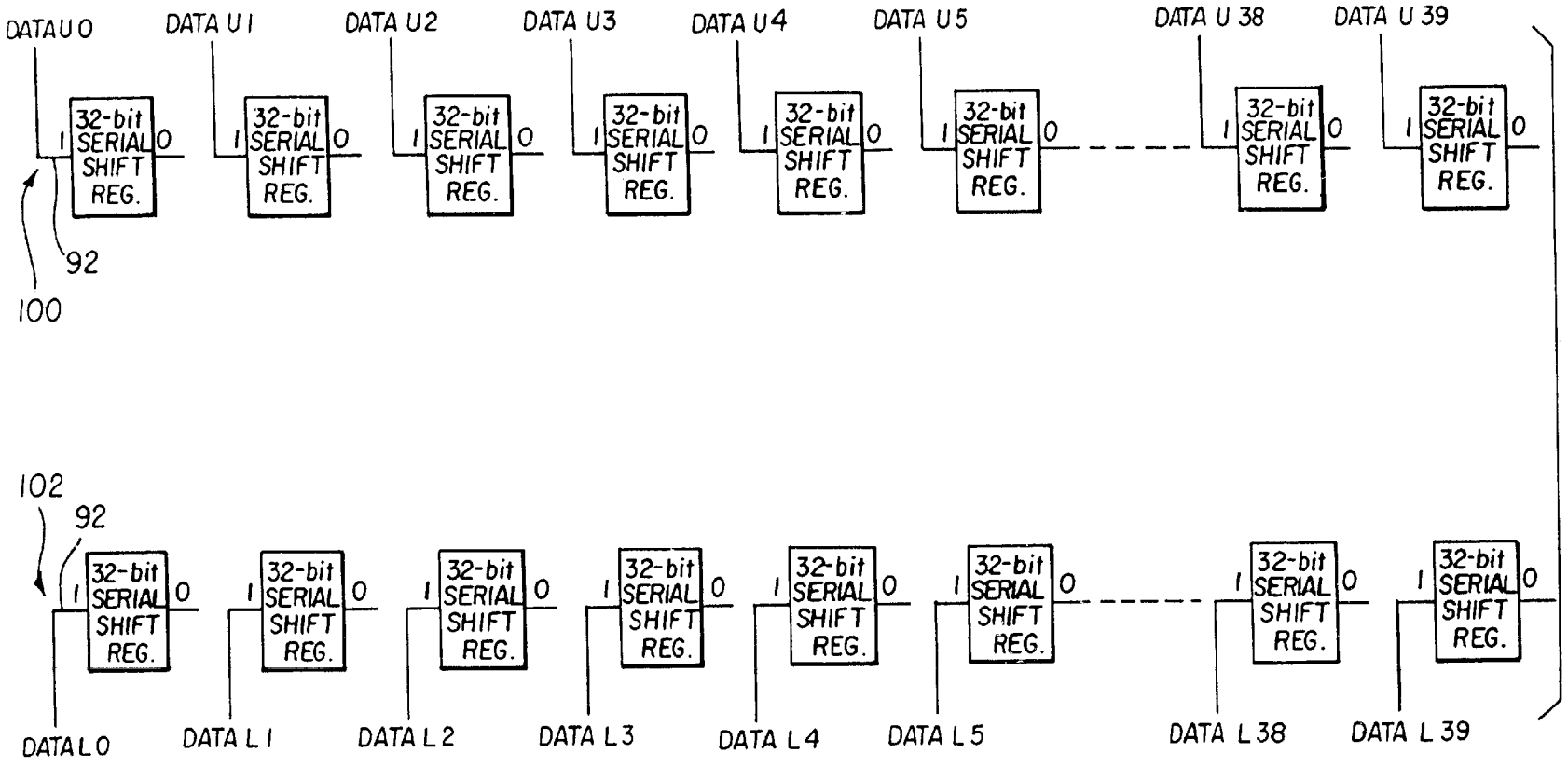
FIG. 7 is a block diagram of a serial shift register configuration in a thermally steered inkjet printhead.

FIG. 7 is a general block diagram of the data structure for a large printhead, such as printhead 10, incorporating a significant number of heaters. For simplicity, the CLOCK 94, LATCH 90, and ENABLE lines 88 have been omitted. For this example there are 40 upper 32-bit serial shift registers 100 and 40 lower 32-bit serial shift registers 102. Each of the 32-bit serial shift registers 100 and 102 has corresponding data inputs, DATAU0–DATAU39 and DATAL0–DATAL39, respectively. Thus there are 80 DATA lines 92 to the printhead.

Figure 8:
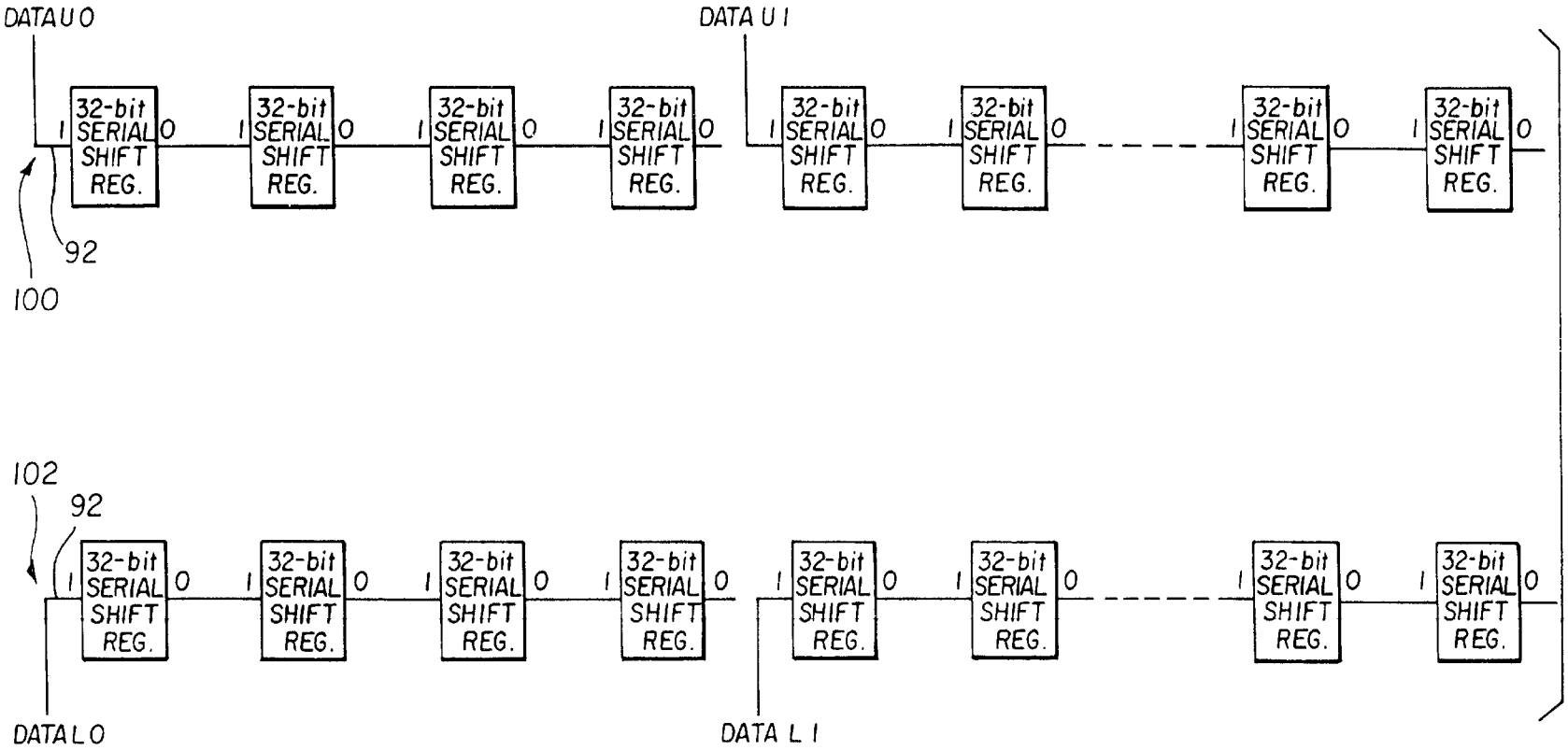
FIG. 8 is a block diagram of the data serial shift register configuration of a printhead.

FIG. 8 is a block diagram of an interconnection scheme for a large printhead with a significant number of heaters. As in FIG. 7, 80 of the 32-bit serial shift registers are shown, however, the data structure has been reconfigured to decrease the number of DATA lines 92 by a factor of 4. Specifically, FIG. 8 shows 4 of the 32-bit shift registers serially connected to form a larger 128-bit serial shift register. Only 20 DATA lines 92 are required for this configuration, compared to 80 DATA lines 92 for FIG. 7. To maintain the same heater address time as in FIG. 7, the frequency of the clock would need to be increased by a factor of 4 since the number of shift register stages in the larger serial shift register has increased from N=32 to N=128. However, there may be physical barriers which prevent the implementation of this architecture. Nevertheless, it is well known that large printheads are often constructed of small devices 108 which are used as modular building blocks for large printheads.

Figure 9:
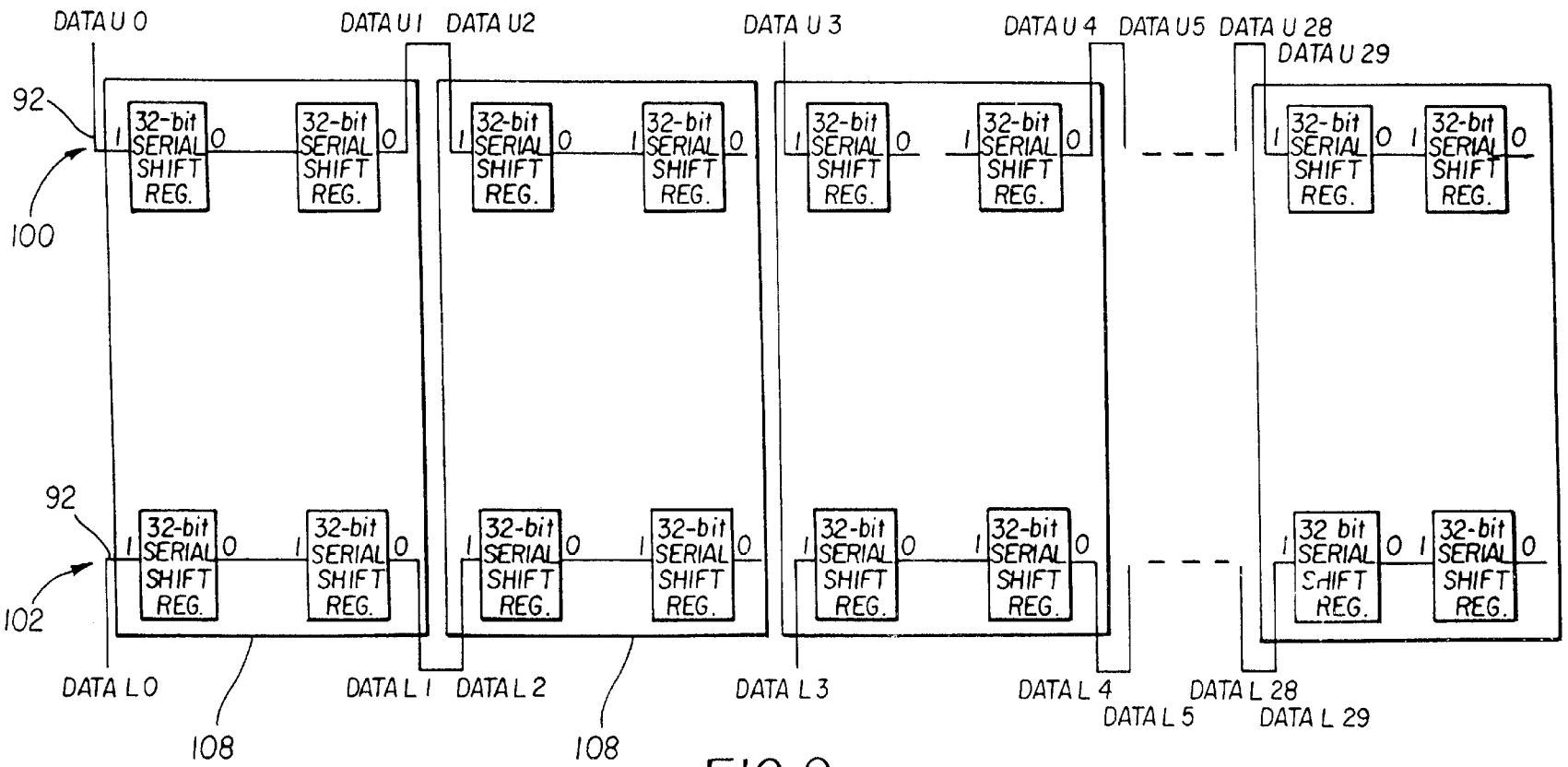
FIG. 9 is a block diagram of the data serial shift registers in a printhead configured with small devices.

FIG. 9 is a block diagram of an interconnection scheme for a large printhead constructed with small devices 108. In this example, each small device 108 contains two 32-bit serial shift registers for the upper serial shift register 100 and two 32-bit serial shift registers for the lower serial shift register 102. Each small device 108 also contains 64 nozzles 24 and the associated 64 upper heaters 28*a* and 64 lower heaters 28*b*. The small devices 108 provide an opportunity to build printheads in a modular fashion, providing flexibility in the size of the printhead.

As shown, the inputs (I) and outputs (O) of the serial shift registers 100 and 102 allow the user to configure the printhead in a manner similar to FIG. 8. However, because the interconnection of the serial shift registers of different small devices 108 would require additional connections to the printhead, the additional connections to the printhead would reduce the advantage of using long shift registers. The example of the printhead of FIG. 9 would require 60 DATA lines 92. Some of these DATA lines 92 are jumpers from one small device 108 to the next small device 108, which accounts for two DATA lines 92. For small devices 108 containing more than two 32-bit registers for the upper serial shift register 100 and more than two 32-bit shift registers for the lower serial shift register 102, the interconnection scheme shown in FIG. 9 would produce a proportionately greater reduction in interconnections to the printhead as to the connection scheme of FIG. 7.

Figure 10:
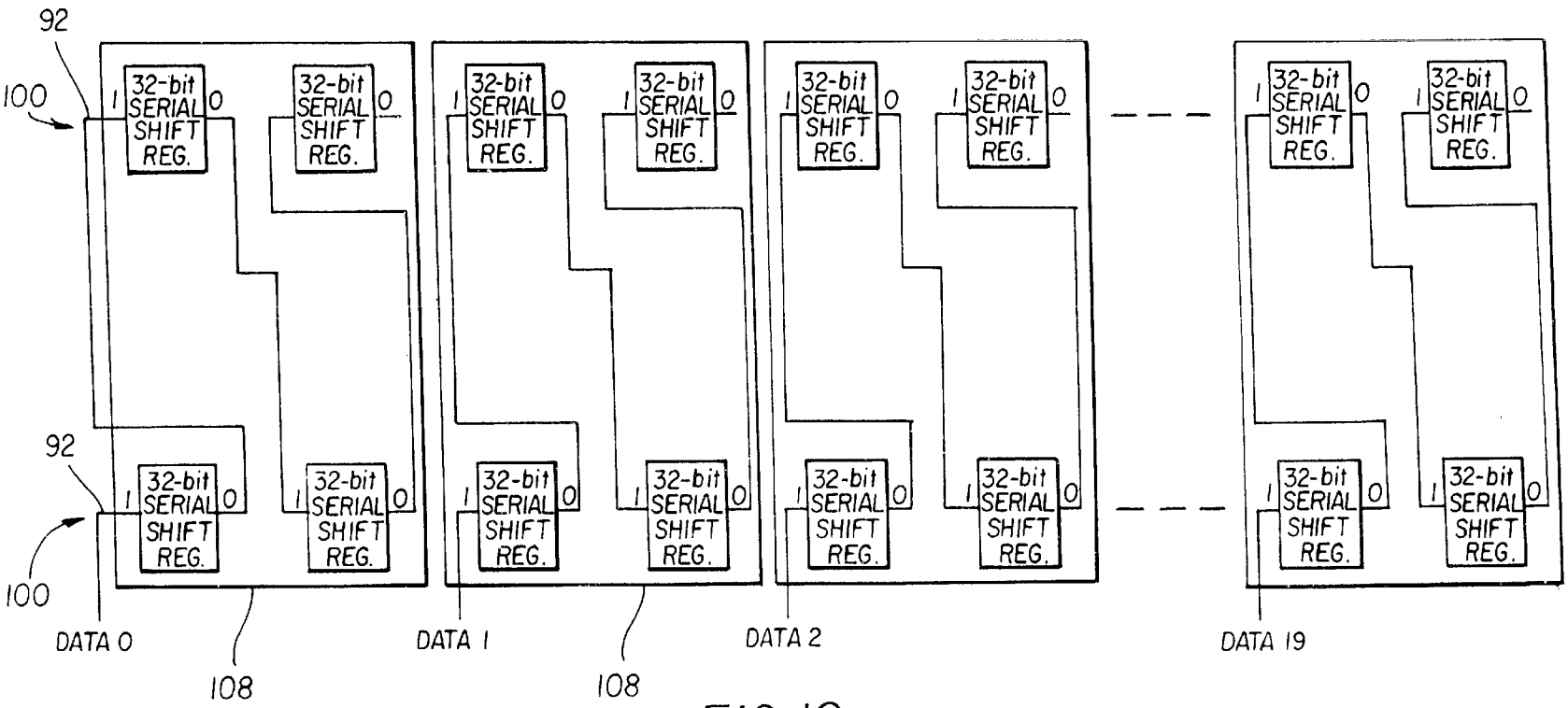
FIG. 10 is a block diagram of the data serial shift registers in a printhead configured with small devices which uses the second embodiment of the invention.

FIG. 10 is a block diagram of an interconnection scheme for a large printhead constructed with modular small devices 108. Because of the use of the small device 108, the printhead could be built in a modular fashion. In the embodiment of FIG. 10, the 32-bit shift registers in the lower serial shift register 102 are connected in serial fashion with the 32-bit shift registers in the upper serial shift register 100. By serially connecting the 4 shift registers within the small device 108, the length of the shift register is again 128-bits as it was in FIG. 9, however, this embodiment provides a significant reduction in interconnections to the printhead. For this example, 20 DATA lines 92 would be required to interconnect to the printhead. The seemingly simple approach shown in FIG. 10 is not obvious because the shift registers constructed in this manner contain different types of data, some for upper heaters and some for lower heaters. In addition, the information in the serial data for upper heater associated with nozzle 1 is separated by 32-bits from the data associated with the lower heater associated with nozzle 1. The creation of this serial bit stream is difficult because the data associated with a given nozzle (upper heater and lower heater) is separated by the number of bits in the small serial shift registers (32-bits in this example).

The embodiment shown in FIG. 10 shows that the upper and lower serial shift registers are serially connected to form a single serial shift register which is used to address the upper and lower heaters 28*a* and 28*b*, respectively. Since there is only one serial shift register in the configuration of FIG. 10 (as opposed to two serial shift registers as shown in FIG. 4, FIG. 6 and FIG. 7), the number of clock lines and latch lines can also be reduced. In FIGS. 4, 6, and 7, two clock lines are required, UPPER_CLOCK 94 and LOWER_CLOCK 94. In the embodiment of FIG. 10, there is a single serial shift register common to both the upper and lower heaters 28*a*, 28*b*, such that the serial shift register can be driven with a single CLOCK line 94. Thus, the present inventions provides an interconnection mechanism that eliminated the requirement of separate LATCH lines for each serial shift register used in the printhead assembly so that a single serial shift register common to upper and lower heaters can be driven with a single LATCH line 90. In this way, the embodiment of FIG. 10 saves an additional two interconnections to the printhead by eliminating separate clock and latch connections.

Figure 11:
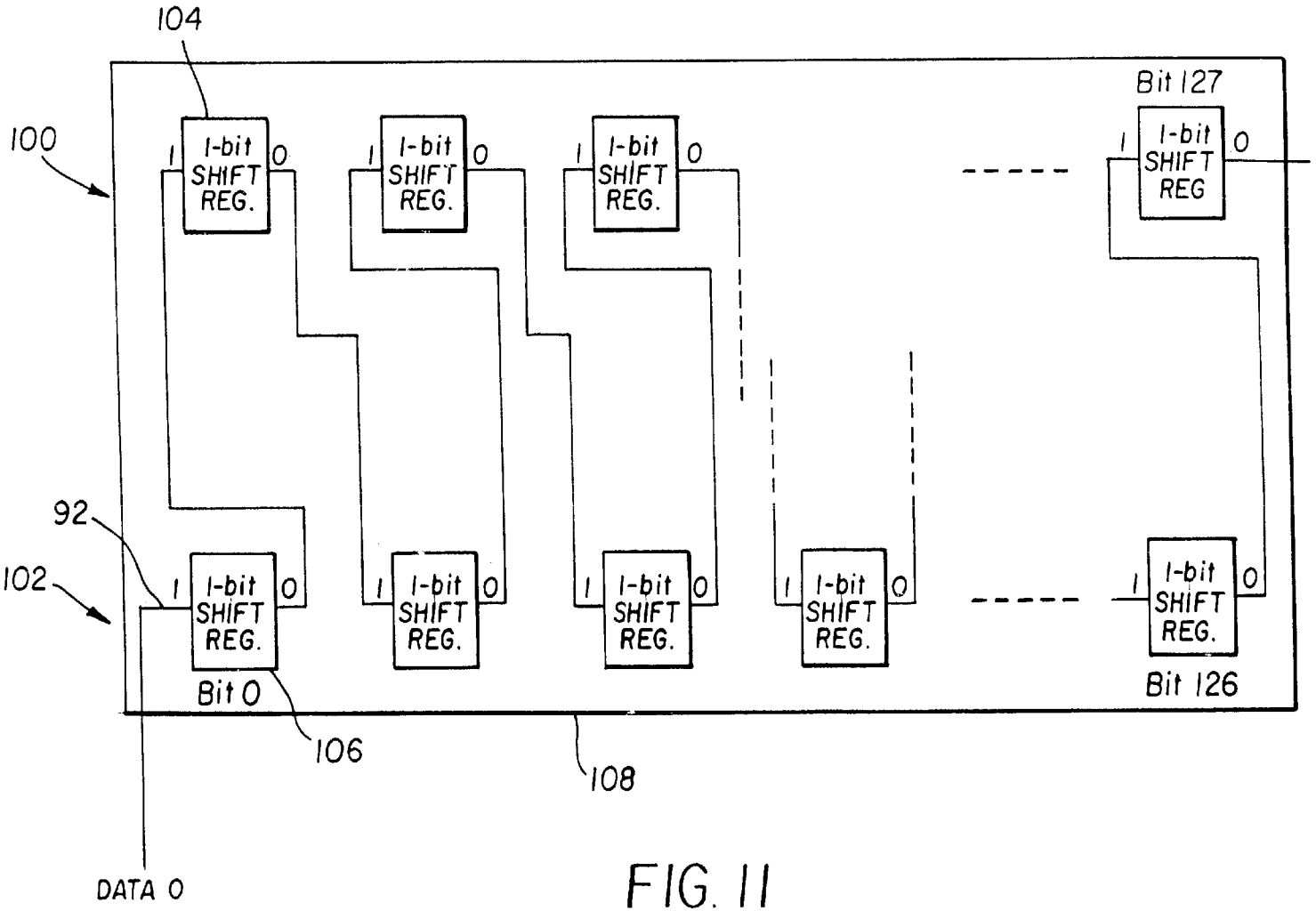
FIG. 11 is a block diagram of the data serial shift registers in a printhead configured with small devices which uses the third embodiment of the invention.

With reference now to FIG. 11, there is shown a third embodiment interconnection scheme that minimizes interconnections in the printhead assembly according to the invention. Specifically, as shown in FIG. 10, the required 32 bit separation of the two data bits (associated with the two heaters 28*a*, 28*b* at a given nozzle 24) in the serial data stream made the creation of the data stream for a DATA line 92 difficult. In contrast, FIG. 11 shows an interconnection of the upper serial shift register 100 and the lower serial shift register 102 where adjacent shift register stages 104, 106 in the combined shift register represent two heaters 28*a*, 28*b* associated with one nozzle 24. The output of a lower shift register stage 106 is connected to an input of the upper shift register stage 104 while the output of the upper shift register stage 104 is connected to the input of the lower shift register stage 106 for a heater associated with the nozzle adjacent to the one nozzle 24, resulting in an alternating interconnection scheme. This alternating interconnection of the upper shift registers 104 and lower shift registers 106 allows the data bits associated with the two heaters 28*a*, 28*b* (associated with a particular nozzle 24) to be adjacent to each other in the data stream, rather than being separated by 32 bits, as was the case in FIG. 10.

The creation of adjacent data bits in the data stream associated with the two heaters 28*a*, 28*b* for a given nozzle is much easier and simplifies the circuitry utilized to create the data stream. In this example all 4 of the 32-bit serial shift registers would be interleaved in the fashion described above, so the complete length of the shift register would be 128 bits. The 128-bit shift register would have one DATA line 92 input from outside the small device 108. FIG. 11 shows that the interconnection scheme can be used to connect the shift registers 104, 106 within one small device 108 in a modular printhead. Thus, the embodiment of FIG. 11 also minimizes the number of DATA lines 92 to a total of 20 for the printhead heater configuration originally described in FIG. 9.

The embodiment shown in FIG. 11 shows the upper and lower shift registers are serially connected to form a single serial shift register which is used to address the upper and lower heaters 28*a* and 28*b*, respectively. Since there is only one serial shift register in the interconnection scheme of FIG. 11 (compared to two serial shift registers in the interconnection schemes of FIGS. 4, 6 and 7), the total number of CLOCK lines and LATCH lines is reduced. In FIGS. 4, 6, FIG. 7, two clock lines are required, UPPER_CLOCK 94 and LOWER_CLOCK 94. In the embodiment of FIG. 11, there is a single serial shift register common to the upper 28*a* and lower heaters 28*b* which can be driven with a single CLOCK line. In this way, the embodiment of FIG. 11 further reduces the number of interconnections of the printhead assembly and eliminates unnecessary clock and latch connections.

Table 1 shows the number of interconnects for the various interconnections schemes of the invention (the interconnects for the ENABLE signals 88 are not included in the table).

TABLE 1

Total number of interconnects for each embodiment of the invention.

| {PRIVATE} INTERCONNECT OBJECTIVE | FIG. | DATA | CLOCK | LATCH | TOTAL INTER-CONNECTS |
|---|---|---|---|---|---|
| Maximum Address Speed | 7 | 80 | 2 | 2 | 84 |
| Continuous Head Reduction | 8 | 20 | 2 | 2 | 24 |
| Modular Head Reduction | 9 | 60 | 2 | 2 | 64 |
| Modular Head Embodiment 2 | 10 | 20 | 1 | 1 | 22 |
| Modular Head Embodiment 3 | 11 | 20 | 1 | 1 | 22 |

While this invention has been described with reference to illustrative embodiments, this description is not intended to be construed in a limiting sense. For example, the principles of the invention can be applied to other types of recording elements, such as LEDs, thermal recording elements, lasers, and other recording element configurations. As such, various modifications and combinations of the illustrative embodiments, as well as other embodiments of the invention, will be apparent to persons skilled in the art upon reference to the description. It is, therefore, intended that the appended claims encompass any such modifications or embodiments.

PARTS LIST

10 . . . inkjet printhead
12 . . . mounting block
14 . . . manifold
16 . . . inlet/outlet tubes
18 . . . fluid flow channels
20 . . . ink reservoir
22 . . . substrate
24 . . . nozzle or nozzles
26 . . . nozzle opening
28 . . . heater or heaters
28*a*. . . upper heater
28*b*. . . lower heater
32 . . . nozzle cavity
34 . . . ink
36 . . . ink stream
50 . . . printer system
54 . . . interface
56 . . . data path and control electronics
58 . . . media
60 . . . drum
61 . . . CONTROL line
62 . . . DATA line
64 . . . ink supply
80 . . . interface
84 . . . heater drivers
86 . . . AND gate logic element
88 . . . ENABLE line
90 . . . LATCH line
92 . . . DATA line
94 . . . CLOCK line
100 . . . serial shift register stage
102 . . . serial shift register stage
104 . . . shift register stage
106 . . . shift register stage
108 . . . small device
122 . . . output

200 . . . print head assembly
204 . . . print data buffer
206 . . . nozzle controller
208 . . . print-data-and-control-signal bus
210 . . . nozzle heater power supply
212 . . . power line

What is claimed is:

1. An inkjet printhead comprising:

a plurality of nozzles having corresponding nozzle openings for delivering ink to a receiver medium;

a plurality of shift registers stages operably coupled to a plurality of actuators associated with said nozzles and adapted to cause ink to be delivered through said nozzles openings in the direction of said receiver medium, each nozzle having associated therewith an upper actuator and a lower actuator, and said plurality of shift register stages being connected into a plurality of multistage shift registers so that some shift registers ("upper shift registers") are arranged to transfer data used to operate upper actuators and other shift registers ("lower shift registers") are arranged to transfer data used to operate lower actuators; and a print data driver operably coupled to said plurality of shift registers via a plurality of interconnections, said plurality of interconnections comprising data lines and clock lines for delivering respectively print data signals and timing signals to said lower and upper shift registers;

wherein said data lines are interleaved between said upper shift registers and said lower shift registers and wherein said print data driver is configured to operate said clock lines by transmitting timing signals that causes said upper and lower shift registers to shift data received over said data lines and thereby position data for transfer for use in operating said plurality of actuators.

2. The inkjet printhead of claim 1, wherein said plurality of actuators comprise heaters designated as upper and lower heaters.

3. The inkjet printhead of claim 2 further comprising upper and lower enable lines operably coupled to said plurality of print nozzle heaters for operating said print nozzle heaters in connection with said upper and lower shift registers, respectively.

4. The printhead of claim 1 wherein said plurality of shift registers are organized into 128 bit length shift registers.

5. A method of providing image data in a printer apparatus, the method comprising:

providing a plurality of recording elements arranged in an array for recording of an image on a receiver medium;

providing a plurality of actuators associated with each respective recording element, each actuator being separately drivable to affect recording by a respective recording element;

providing a first plural number of shift register stages and the first plural number of the actuators, each stage being associated with a respective different actuator of the first plural number of the actuators, each recording element being associated with different shift register stages, and the first plural number of shift register stages being associated with the first plural number of recording elements and being connected as a first shift register of plural shift register stages for shifting data from one stage associated with one recording element of the first plural number of recording elements directly to another shift register stage associated with another recording element of the first plural number of recording elements to distribute data to the different stages, so that for most of the stages forming the first shift register, data shifted into a stage associated with an actuator for one recording element is shifted directly into a stage associated with another actuator for a different recording element in the course of shifting data from stage to stage;

providing a second plural number of shift register stages and the second plural number of the actuators, each stage of said second plural number of shift register stages being associated with a respective different actuator of the second plural number of the actuators, and the second plural number of shift register stages being associated with the second plural number of recording elements and being connected as a second shift register of plural shift register stages for shifting data from one stage associated with one recording element of the second plural number of recording elements directly to another shift register stage associated with another recording element of the second plural number of recording elements to distribute data to the different stages so that, for most stages of the second shift register, the data shifted into a stage associated with an actuator for one recording element of the second plural number of recording elements is shifted directly into a stage associated with another actuator for a different recording element of the second plural number of recording elements in the course of shifting data from stage to stage; and wherein at least some of the recording elements in the second plural number of recording elements are the same recording elements in the first plural number of recording elements and wherein the first plural number of shift register stages all are different shift register stages from the second plural number of shift register stages and the first plural number of actuators all are different actuators from the second plural number of actuators.

6. The method of claim 5 and wherein each recording element is a nozzle on an ink jet printhead.

7. The method of claim 6 and wherein the actuators are each a heater element.

8. The method of claim 5 and wherein data output from one shift register stage of the second plural number of shift register stages is input to a shift register stage of the first plural number of shift register stages.

9. The method of claim 8 and wherein each recording element is a nozzle on an ink jet printhead.

10. The method of claim 9 and wherein the actuators are each a heater element.

11. The method of claim 5 and wherein the first and second shift registers each has a respective separate data input line with parallel inputs of data into the first and second shift registers.

12. The method of claim 11 and wherein each recording element is a nozzle on an inkjet printhead.

13. The method of claim 5 and wherein there are plural ones of said first shift registers and plural ones of said second shift registers, and each of said first shift registers and each of said second shift registers has a separate respective data input line with parallel receipt of data into the plural ones of said first and second shift registers.

14. The method of claim 13 and wherein each recording element is a nozzle on an inkjet printhead.

15. The method of claim 5 and wherein there are plural ones of said first shift registers and plural ones of said second shift registers, and each of said first shift registers and each of said second shift registers has a separate respective data input line, and wherein one of said first shift registers has data input onto its respective data input line from an output of another one of said first shift registers and wherein one of said second shift registers has data input onto its respective data input line from an output of another one of said second shift registers.

16. The method of claim 15 and said first and second shift registers are mounted as a module and plural of the modules are assembled on the printhead and transfer data from the first and second shift registers on one module to the first and second shift registers on another module.

17. The method of claim 16 and wherein each recording element is a nozzle on an inkjet printhead.

18. The method of claim 1 and wherein each recording element is a nozzle on an inkjet printhead.

19. A printer apparatus comprising:

a plurality of recording elements arranged in an array for recording of an image on a receiver medium;

a plurality of actuators associated with each respective recording element, each actuator being separately drivable to affect recording by a respective recording element;

a first plural number of shift register stages and a first plural number of the actuators, each stage being associated with a respective different actuator of the first plural number of the actuators, each recording element being associated with different shift register stages, and the first plural number of shift register stages being associated with the first plural number of the recording elements and being connected as a first shift register of plural shift register stages for shifting data from one stage associated with one recording element of the first plural number of recording elements directly to another shift register stage associated with another recording element of the first plural number of recording elements to distribute data to the different stages so that, for most of the stages forming the first shift register, data that is shifted into a stage associated with an actuator for one recording element may be shifted directly into a stage associated with another actuator for a different recording element in the course of shifting data from stage to stage;

a second plural number of shift register stages and a second plural number of the actuators, each stage of said second plural number of shift register stages being associated with a respective different actuator of the second plural number of the actuators, and the second plural number of shift register stages being associated with a second plural number of recording elements and being connected as a second shift register of plural shift register stages for shifting data from one stage associated with one recording element of the second plural number of the recording elements directly to another shift register stage associated with another recording element of the second plural number of recording elements to distribute data to the different stages so that, for most stages of the second shift register, the data shifted into a stage associated with an actuator for one recording element of the second plural number of recording elements may be shifted directly into a stage associated with another actuator for a different recording element of the second plural number of recording elements in the course of shifting data from stage to stage; and wherein at least some of the recording elements in the second plural number of recording elements are the same recording elements in the first plural number of recording elements and wherein the first plural number of shift register stages all are different shift register stages from the second plural number of shift register stages and the first plural number of actuators all are different actuators from the second plural number of actuators.

20. The apparatus of claim 19 and wherein each recording element is a nozzle on an ink jet printhead.

21. The apparatus of claim 20 and wherein the actuators are each a heater element.

22. The apparatus of claim 19 and wherein data output from one shift register stage of the second plural number of shift register stages may be input to a shift register stage of the first plural number of shift register stages.

23. The apparatus of claim 22 and wherein each recording element is a nozzle on an ink jet printhead.

24. The apparatus of claim 23 and wherein the actuators are each a heater element.

25. The apparatus of claim 19 and wherein the first and second shift registers each has a respective separate data input line with parallel inputs of data into the first and second shift registers.

26. The apparatus of claim 25 and wherein each recording element is a nozzle on an inkjet printhead.

27. The apparatus of claim 19 and wherein there are plural ones of said first shift registers and plural ones of said second shift registers, and each of said first shift registers and each of said second shift registers has a separate respective data input line with parallel receipt of data into the plural ones of said first and second shift registers.

28. The apparatus of claim 27 and wherein each recording element is a nozzle on an inkjet printhead.

29. The apparatus of claim 19 and wherein there are plural ones of said first shift registers and plural ones of said second shift registers, and each of said first shift registers and each of said second shift registers has a separate respective data input line, and wherein one of said first shift registers has data input onto its respective data input line from an output of another one of said first shift registers and wherein one of said second shift registers has data input onto its respective data input line from an output of another one of said second shift registers.

30. The apparatus of claim 29 and wherein each recording element is a nozzle on an inkjet printhead.

31. The apparatus of claim 19 and wherein some of said first and second shift registers are mounted as a module and plural of the modules are assembled on the printhead and transfer data from the first and second shift registers on one module to the first and second shift registers on another module.

32. The apparatus of claim 31 and wherein each recording element is a nozzle on an inkjet printhead.

33. An inkjet printhead comprising:

a plurality of nozzles having corresponding nozzle openings for delivering ink to a receiver medium;

a plurality of actuators associated with said nozzles, said actuators comprising a first counterpart set of first actuators and a second counterpart set of second actuators, each nozzle having associated therewith a first actuator from the first counterpart set and a second actuator from the second counterpart set;

a plurality of shift registers stages operably coupled to a plurality of actuators associated with said nozzles and adapted to shift data associated with actuation of said first and second actuators, and said plurality of shift register stages being connected into a multistage shift register so that some shift register stages are arranged to transfer first data from the shift register to control operation of the first actuators and other shift stages are arranged to transfer second data from the shift register to control operation of the second set of second actuators; and a print data driver operably coupled to said shift register, said driver providing an alternating sequence of first and second data for the control of operation of the first and second actuators wherein there is simultaneously present in the shift register the first and second data for control of the first and second actuators.

34. The printhead of claim 33 and wherein the print data driver provides an alternating sequence of data such that for at least some shift register stages alternating bits of first and second data are provided to be shifted through said stages with a data bit from the first data being followed directly by a data bit from the second data and then followed directly by a data bit from the first data that are shifted through each shift register stage of said at least some shift register stages.

35. The printhead of claim 33 and wherein the print data driver provides an alternating sequence of data such that for at least some shift register stages alternating bits of first and second data are provided to be shifted through said stages with a series of plural data bits from the first data being followed directly by a series of plural data bits from the second data and then followed directly by a series of plural data bits from the first data that are shifted through each shift register stage of said at least some shift register stages.

36. A method of providing data to an inkjet printhead, the method comprising:

providing a printhead having a plurality of nozzles having corresponding nozzle openings for delivering ink to a receiver medium;

providing a plurality of actuators associated with said nozzles, said actuators comprising a first counterpart set of first actuators and a second counterpart set of second actuators, each nozzle having associated therewith a first actuator from the first counterpart set and a second actuator from the second counterpart set;

providing a plurality of shift registers stages operably coupled to a plurality of actuators associated with said nozzles and adapted to shift data associated with actuation of said first and second actuators, and said plurality of shift register stages being connected into a multistage shift register so that some shift register stages operate to transfer first data from the shift register to control operation of the first actuators and other shift stages operate to transfer second data from the shift register to control operation of the second set of second actuators; and providing an alternating sequence of first and second data for the control of operation of the first and second actuators wherein there is simultaneously present in the shift register the first and second data for control of the first and second actuators.

37. The method of claim 36 and wherein the there is provided an alternating sequence of data such that for at least some shift register stages alternating bits of first and second data are provided to be shifted through said stages with a data bit from the first data being followed directly by a data bit from the second data and then followed directly by a data bit from the first data that are shifted through each shift register stage of said at least some shift register stages.

38. The method of claim 36 and wherein there is provided an alternating sequence of data such that for at least some shift register stages alternating bits of first and second data are provided to be shifted through said stages with a series of plural data bits from the first data being followed directly by a series of plural data bits from the second data and then followed directly by a series of plural data bits from the first data that are shifted through each shift register stage of said at least some shift register stages.

* * * * *